United States Patent [19]

Sumpter

[11] 3,943,894

[45] Mar. 16, 1976

[54] INTERNAL COMBUSTION ENGINE WITH CLUTCH TRANSMISSION

[76] Inventor: Willie J. Sumpter, 2133 Montclair, Detroit, Mich. 48214

[22] Filed: May 16, 1974

[21] Appl. No.: 470,402

[52] U.S. Cl. ..... 123/54 R; 123/197 R; 192/46

[51] Int. Cl.[2] ..... F02B 75/26

[58] Field of Search ..... 123/46 C, 197 R, 197 C, 123/54 R; 192/41 R, 46, 46 R

[56] References Cited

UNITED STATES PATENTS

| | | | |
|---|---|---|---|
| 1,033,939 | 7/1912 | Robb et al. | 123/197 R |
| 1,291,642 | 1/1919 | Elwell | 123/54 R |
| 1,304,129 | 5/1919 | Walk | 123/197 C |
| 1,347,055 | 7/1920 | Peterson | 123/197 C |
| 1,566,378 | 12/1925 | Defordt | 192/46 |
| 3,114,355 | 12/1963 | Moo | 123/197 C X |

FOREIGN PATENTS OR APPLICATIONS

| | | | |
|---|---|---|---|
| 396,049 | 7/1933 | United Kingdom | 123/197 C |

*Primary Examiner*—Charles J. Myhre
*Assistant Examiner*—William C. Anderson
*Attorney, Agent, or Firm*—Harness, Dickey & Pierce

[57] ABSTRACT

An internal combustion engine having a plurality of pairs of pistons, each piston having a fixed connecting rod operating a ratchet on the crankshaft through a crank and pawls. The ratchet for each piston is coplanar with the connecting rod, and the two pistons of each pair are interconnected by a rocker arm for alternate piston return. Each pair of interconnected pistons operates independently of the other pairs so that if any pair is stopped through damage, the other pairs will not be affected.

8 Claims, 4 Drawing Figures

29
17
12
11
16
74
73
32
22
24
75
76
78
27
2
3
14
34
15
19
33
43
31
35
76
46
75
13
77
69
3
74
78

16
36
34
43
19
37
33
45
39
41
15
47
38
21
15
36
44
37
16

INTERNAL COMBUSTION ENGINE WITH CLUTCH TRANSMISSION

BACKGROUND OF THE INVENTION

Field of the Invention

The invention relates to internal combustion engines in which reciprocating pistons are connected to a crankshaft by a pawl-and-ratchet arrangement, to convert the linear piston movement to rotary motion. The invention is particularly applicable to internal combustion engines used in racing cars and other types of vehicles where the engine has high performance requirements. It is important in such engines that damage to a piston or its connected parts which prevents movement of that piston not interfere with operation of the undamaged portions of the engines.

BRIEF SUMMARY OF THE INVENTION

It is an object of the invention to provide a novel and improved internal combustion engine with a pawl-and-rachet drive between the pistons and crankshaft, in which the ratchets are in the planes of the connecting rods and thus act as efficient force-transmitting elements with a minimum of unbalanced forces on the parts.

It is another object to provide an improved internal combustion engine of this type in which simple and reliable means are provided for pairing the pistons so as to cause the two pistons of each pair to travel alternately in their compression strokes. This means is such that each pair of pistons will be independent of the others, permitting the engine to continue to operate when one pair can no longer reciprocate due to damage.

In summary, the invention comprises an internal combustion engine in which each piston has a fixed connecting rod, a rotatably mounted crankshaft, a ratchet on said crankshaft in the plane of the connecting rod, a pawl arm rotatably mounted on said crankshaft in the plane of said connecting rod, pawls carried by the pawl arm and engageable with the rachet, and a pin-and-slot connection between said pawl arm and connecting rod.

Further, the invention comprises an internal combustion engine having at least one pair of side-by-side pistons with parallel movement, connecting rods on said pistons, a rotatable crankshaft, ratchets on said crankshaft in the planes of said connecting rods, pawl arms rotatably carried by said crankshaft and having pawls engageable with said ratchets, means connecting said connecting rods to said pawl arms, and means for moving each piston of the pair through its compression stroke when the other piston is moving through its power stroke, said means comprising a rocker arm having a fixed central pivot disposed between said connecting rods, and axial slots in said connecting rods, the outer ends of said arm being disposed in said slots. The invention contemplates a plurality of such pairs of cylinders so that stoppage of any pair due to damage will not affect operation of the others.

DESCRIPTION OF THE PREFERRED EMBODIMENT

Figure 1:
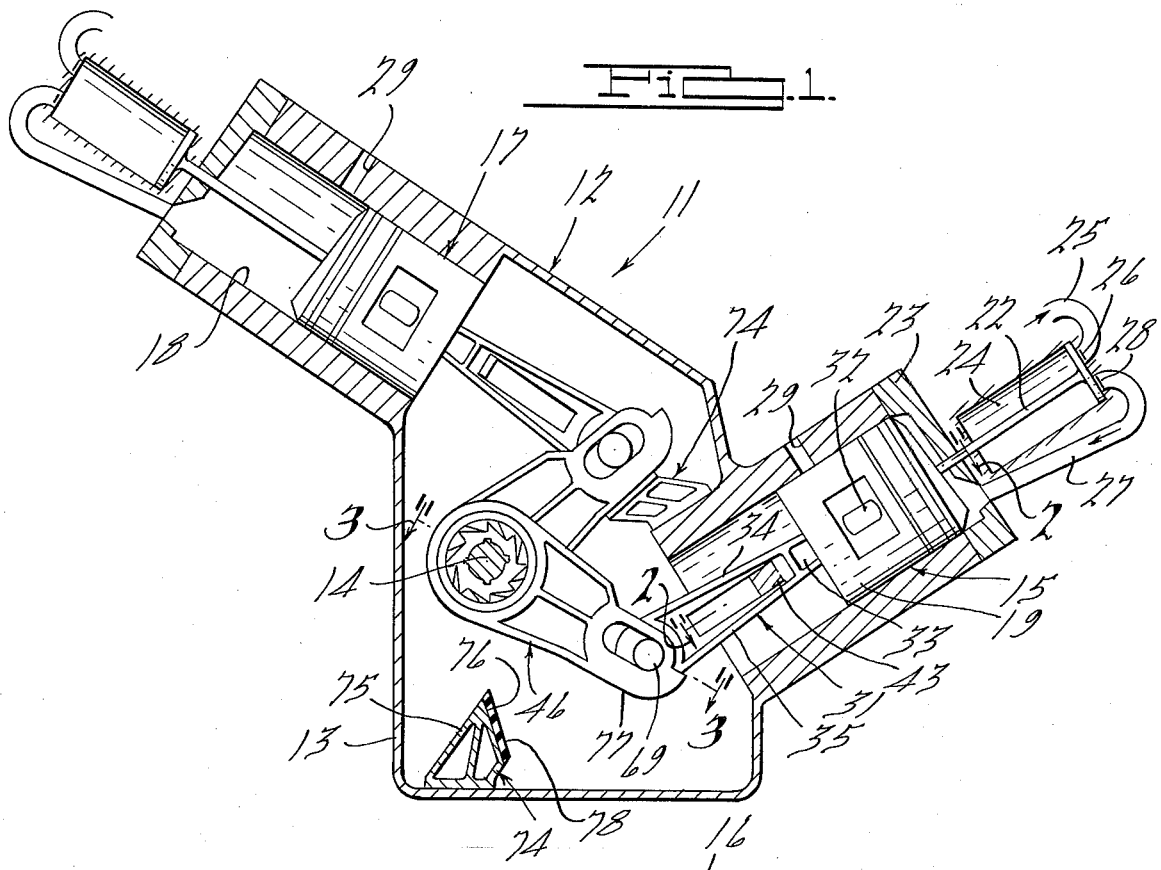
FIG. 1 is a partially schematic side elevational view in cross section showing a piston from each of two pairs and the parts which connect them to the crankshaft.

The internal combustion engine is generally indicated at 11 and comprises a cylinder block generally indicated at 12. In the figures, conventional engine parts have been omitted which are not essential for understanding of the present invention. As shown, the block has an oil pan 13, a horizontal rotatable crankshaft 14, and a plurality of pairs of pistons, a typical pair being indicated generally at 15 in FIG. 2. The pair of pistons 15 are slidable in cylinders 16. As illustrated, a second pair of pistons is seen partially and indicated generally at 17 in FIG. 1, these pistons being slidable in cylinders 18. Cylinders 16 and 18 are shown as being in angular relation although this may be varied to suit requirements.

The construction of the pistons in pair 15 and their associated parts is illustrative of the other piston pairs. Each piston 19 and 21 of pair 15 are in side-by-side relation for parallel movement. The engine is shown as having a two-stroke cycle, with each piston carrying a plunger 22 extending through the cylinder head 23 into a fuel injector chamber 24. This chamber has a fuel-and-air intake passage 25 with a check valve 26, and a passage 27 with a check valve 28 for forcing fuel from injector chamber 24 into cylinder 16. Thus, on each down or power stroke the fuel-air mixture will be drawn into chamber 22, and on each compression stroke the mixture will be forced from this chamber into the cylinder for ignition. Exhaust ports 29 may be provided in cylinder 16 in the usual manner for two-cycle engines (FIG. 1).

Figure 2:
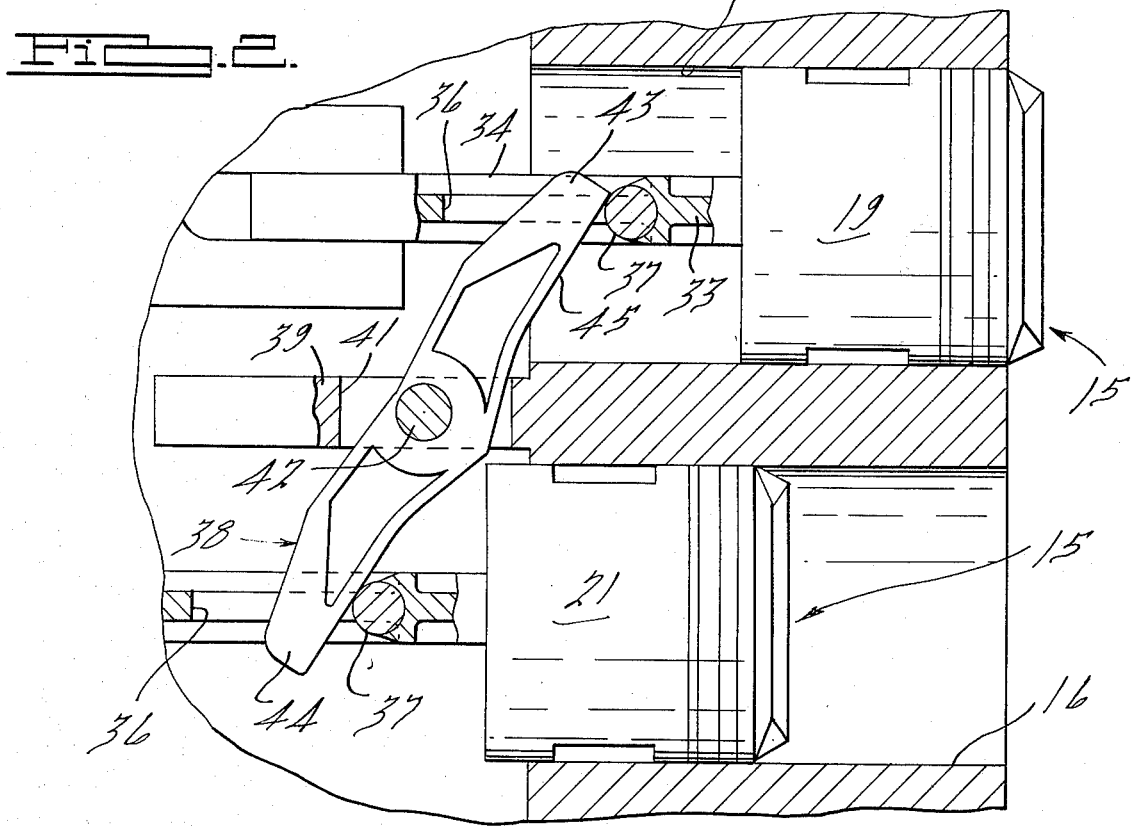
FIG. 2 is an enlarged fragmentary plan view in cross section, with parts omitted, taken along the line 2—2 of FIG. 1, of the two pistons of a pair showing the rocker arm disposed between their connecting rods.

A connecting rod generally indicated at 31 is secured to each piston 19 and 21 of each pair. The connection 32 between the connecting rod and piston is rigid so that there is no "wrist pin" action. The portion 33 of each connecting rod 31 adjacent its piston is illustrated as solid (FIG. 2). Diverging flanges 34 and 35 are formed on the connecting rod, and an elongated slot 36 is formed between these flanges at an intermediate portion of the connecting rod. The end of this slot adjacent connecting rod portion 33 is rounded as indicated at 37 in FIG. 2.

A rocker arm generally indicated at 38 is carried by the block and engageable with rounded slot ends 37. More particularly, block 12 has an inward extension 39 between the pistons of each pair, this extension having an elongated slot 41. Rocker arm 38 is pivotally mounted at 42 within this slot and has a pair of arms 43 and 44 extending in opposite directions. The outer ends of these arms are disposed within slots 36, the arms being provided with surfaces 45 engageable by rounded slot ends 37. The location of pivot 42 is such that when one piston of a pair is in its uppermost position within the cylinder, the other piston will be in its lowermost postion. As each piston is driven downwardly on its end stroke, the rounded slot ends 37 of its connecting rod will engage rocker arm 38, causing the arm to return the other piston to its uppermost position.

Each rocker arm only controls the positions of the two pistons in its pair but has no connection with the other piston pairs of the engine. Thus, should one piston pair be unable to reciprocate, for example due to seizing, this will not affect rotation of the crankshaft by the other pistons.

Figure 3:
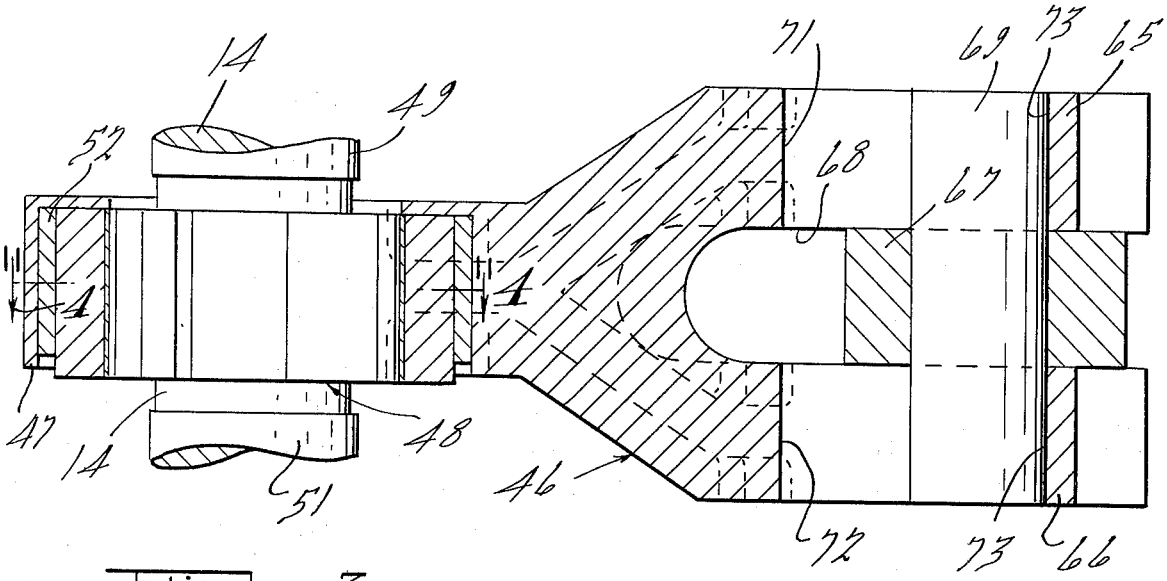
FIG. 3 is a fragmentary plan cross-sectional view taken along the line 3—3 of FIG. 1 and showing the manner in which the pawl arm is rotatably mounted on the crankshaft.

A pawl arm generally indicated at 46 is provided for each connecting rod 31. The pawl arm has a relatively wide end portion 47 surrounding crankshaft 14, and a ratchet generally indicated at 48 is non-rotatably mounted on the crankshaft in the plane of connecting rod 31. As seen in FIG. 3, a ratchet 48 is typically disposed between crankshaft bearings 49 and 51. One ratchet 48 is provided for each piston.

Figure 4:
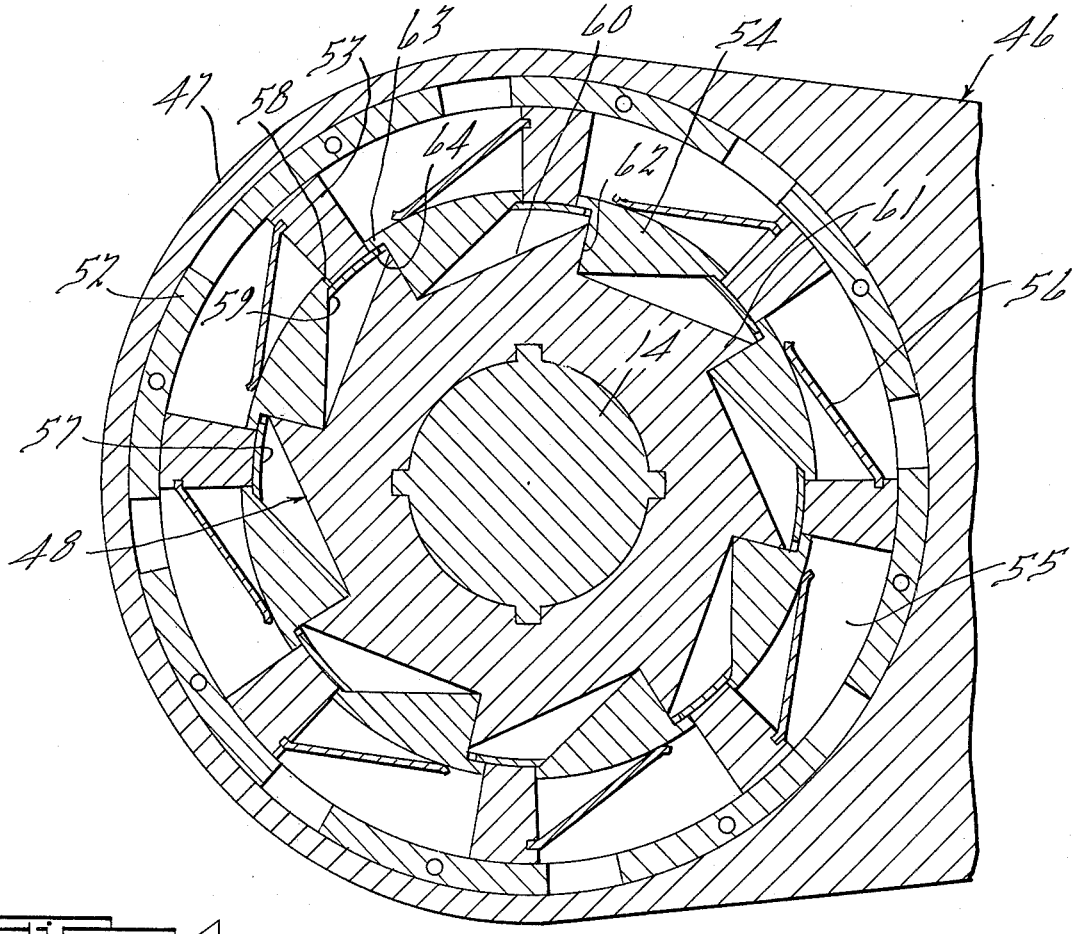
FIG. 4 is a fragmentary cross-sectional view in elevation taken along the line 4—4 of FIG. 3 and showing the pawl-and-ratchet construction.

An annular member 52 is disposed within pawl arm portion 47, and elements 53 extend radially inwardly from member 52 toward ratchet 48. Pawls 54 are disposed in the spaces 55 between elements 53. Leaf springs 56 are each secured at one end to elements 53 and engage the outer surfaces of pawl 54, urging them toward ratchet 48. Elements 57 are disposed at the inner ends of elements 53, and pawls 54 have hinge portions 58 resting on edges 59 of elements 57 which project from one side of element 53. Thus, as pawl arm 46, member 52, elements 53 and 57, and pawls 54 rotate clockwise in FIG. 4 with respect to ratchet 48, pawls 54 will ride up ramps 60 of ratchet teeth 61 until they are snapped down by springs 56 in front of radial surfaces 62 of the ratchet teeth. Projections 63 on pawls 54 will engage edges 64 of elements 57 projecting from the other side of elements 53 to limit inward movement of the pawls. When pawl arm 46 rotates counterclockwise in FIG. 4, pawls 54 will thus drive ratchet 48 and crankshaft 14.

A pair of spaced parallel arms 65 and 66 are formed at the outer end of each pawl arm 46. The outer end 67 of connecting rod 31 is disposed in the space 68 between arms 65 and 66, and carries a pin 69. This pin extends from both sides of connecting rod 67 into a pair of elongated slots 71 and 72 formed in arms 65 and 66 respectively. It will be seen in FIG. 1 that this constitutes a driving connection between the connecting rod and pawl arm so that the pawl arm will be driven clockwise when piston 15 is moving downwardly through its power stroke, and will be returned counterclockwise when the piston moves upwardly through its compression stroke. When the piston is in its uppermost position within the cylinder, pin 69 will be at the rounded ends 73 of slots 71 and 72, whereas the pins will be at a midportion of the slot when the piston is in the lowermost position.

A stop generally indicated at 74 is provided for limiting the powered movement of each pawl arm. This stop is mounted within the housing and a typical construction is seen in FIG. 1. The stop has an upstanding member 75 with a surface 76 aligned with and engageable by a flat surface 77 of the pawl arm. Surface 76 is preferably aligned with and at right angles to the axis of the piston and connecting rod. A resilient pad 78 is mounted on surface 76 and engageable by pawl arm surface 77 when the piston has reached its lowermost position. This will coincide with the other piston in the same pair reaching its uppermost position.

In operation, one piston in each pair will drive crankshaft 14 while the other piston is compressing its next change. With more than one pair of pistons, the driving may be staggered so that crankshaft 14 is being continually subjected to rotative forces from at least one piston. Considering piston pair 15 in particular, and starting from a position as shown in FIGS. 1 and 2 in which piston 19 is at the top of its stroke and piston 21 at the bottom, piston 19 will begin its downward or power stroke. This will cause its ratchet 48 to drive crankshaft 14 and at the same time cause rocker arm 38 to move piston 21 on its compression stroke. During the power stroke of piston 19 its pawls 54 will drive ratchet 48, while the pawls of piston 21 are riding up on ramps 60. Plunger 26 of piston 19 will draw the fuel-air mixture into chamber 24 whereas the plunger of piston 21 will force a fuel-air mixture from its chamber 24 into its cylinder 16.

As piston 19 approaches the bottom of its stroke, it will uncover its exhaust port 29 so that the burned gases will escape. At about the time pawl arm 46 of piston 19 engages its stop 74, the fuel-air mixture in the cylinder of piston 21 will be ignited. Pistons 21 and 19 will then go through their power and compression strokes respectively.

Should either piston in any pair be prevented from movement, the other piston in that pair will also stop. However, this will not impede the operation and power output of the other piston pairs which will continue to drive crankshaft 14 in their usual manner.

I claim:

1. In an internal combustion engine, a plurality of pistons, each piston having a connecting rod fixed thereto, a rotatably mounted crankshaft, a plurality of one-way ratchets on said crankshaft, each ratchet being in the plane of a connecting rod, a pawl arm for each piston rotatably carried by said crankshaft, pawls carried by each pawl arm and engageable with said ratchet, and a pin-and-slot connection between each pawl arm and its connecting rod.

2. The combination according to claim 1, each pawl arm having a portion surrounding its ratchet, elements extending inwardly from said pawl arm portion, said pawls being hinged to said inwardly extending elements, and springs carried by said inwardly extending elements and urging said pawls against said ratchet.

3. The combination according to claim 1, the pin-and-slot connection comprising a pair of arms at the outer end of said pawl arm, a portion of the connecting rod being disposed between said arms, a pin carried by said connecting rod portion, and elongated slots in said arms within which said pin extends.

4. The combination according to claim 3, said pistons being in pairs, each pair being in parallel side-by-side relation, and means interconnecting the connecting rods of each pair of pistons, said means being responsive to the downward stroke of one piston to urge the other piston in an upward direction.

5. The combination according to claim 1, further provided with a stop for each pawl arm, said stop comprising a stationary member having a resilient pad in the path of an outer portion of the pawl arm and engageable by said outer end when the corresponding piston reaches the downward end of its stroke.

6. In an internal combustion engine, at least one pair of side-by-side pistons with parallel movement, connecting rods secured to said pistons, a rotatable crankshaft, one-way ratchets on said crankshaft in the planes of said connecting rods, pawl arms rotatably carried by said crankshaft, pawls carried by said pawl arms and engageable with the ratchets, and means for moving each piston in an upstroke when the other piston moves in a downstroke, said last-mentioned means comprising a rocker arm having a fixed central pivot disposed between said connecting rods, and slots in said connecting rods, the outer ends of said arm being disposed within said slots.

7. The combination according to claim 6, the ends of said slots adjacent their corresponding pistons being rounded, said arm ends in the slots having flat surfaces engageable with said rounded slot ends.

8. The combination according to claim 6, there being a plurality of pairs of pistons, the reciprocation of each piston pair being independent of the other pairs, whereby stopping of one pair due to failure will not affect the crankshaft driving movement of the other pairs.

* * * * *